US006601633B2

(12) United States Patent
Sun et al.

(10) Patent No.: US 6,601,633 B2
(45) Date of Patent: Aug. 5, 2003

(54) INSULATED GLASS BLIND ASSEMBLY

(75) Inventors: Luann Y. Sun, Holland, MI (US); Benjamin P. Hummel, Fennville, MI (US)

(73) Assignee: ODL, Incorporated, Zeeland, MI (US)

( * ) Notice: Subject to any disclaimer, the term of this patent is extended or adjusted under 35 U.S.C. 154(b) by 0 days.

(21) Appl. No.: 09/971,246

(22) Filed: Oct. 4, 2001

(65) Prior Publication Data

US 2003/0066614 A1 Apr. 10, 2003

(51) Int. Cl.[7] ..... E06B 9/26

(52) U.S. Cl. ..... 160/107; 160/168.1 R; 160/176.1 R

(58) Field of Search ..... 160/107, 168.1 R, 160/176.1 R, 177 R, 902, DIG. 16; 49/64; 52/202

(56) References Cited

U.S. PATENT DOCUMENTS

| | | | | |
|---|---|---|---|---|
| 2,389,956 A | | 11/1945 | Castilonia | |
| 2,557,978 A | | 6/1951 | Krumm | |
| 2,639,766 A | | 5/1953 | Pratt | |
| 3,201,832 A | | 8/1965 | Hordis et al. | |
| 3,318,360 A | | 5/1967 | Persson | |
| 3,342,243 A | | 9/1967 | Salter | |
| 3,443,624 A | | 5/1969 | Toth | |
| 3,703,920 A | | 11/1972 | Debs | |
| 3,719,221 A | | 3/1973 | Hanson | |
| 3,795,267 A | | 3/1974 | Debs | |
| 4,459,778 A | * | 7/1984 | Ball | 49/64 |
| 4,588,012 A | | 5/1986 | Anderson | |
| 4,664,169 A | | 5/1987 | Osaka et al. | |
| 4,679,610 A | | 7/1987 | Spraggins | |
| 4,817,698 A | | 4/1989 | Rossini et al. | |
| 4,979,552 A | * | 12/1990 | Van Der Zanden | 160/107 |
| 5,178,200 A | | 1/1993 | Hagan | |
| 5,226,466 A | | 7/1993 | Coddens | |
| 5,379,825 A | | 1/1995 | Jelic | |
| 5,396,944 A | | 3/1995 | Rossini | |
| 5,699,845 A | | 12/1997 | Jelic | |
| RE35,926 E | | 10/1998 | Hagen | |
| 5,826,638 A | | 10/1998 | Jelic | |

FOREIGN PATENT DOCUMENTS

| | | | | |
|---|---|---|---|---|
| FR | 2646205 | * | 10/1990 | 160/107 |
| FR | 2672335 | * | 7/1992 | 160/107 |
| WO | WO 90/15914 | * | 6/1990 | 160/107 |

* cited by examiner

*Primary Examiner*—Bruce A. Lev
(74) *Attorney, Agent, or Firm*—Warner Norcross & Judd

(57) ABSTRACT

An insulated glass window with an integral blind assembly. At least one of the glass spacer corner keys includes an integral pulley for cords associated with the blind. An operator on an exterior surface of the glass includes a leg slidably retained between the frame and the glass to maintain the operator in contact with the window and the blind mechanism enclosed therein.

16 Claims, 5 Drawing Sheets

INSULATED GLASS BLIND ASSEMBLY

BACKGROUND OF THE INVENTION

I. Field of the Invention

The present invention relates to insulated glass blinds and shades and more particularly to actuators for such blinds and shades.

II. Description of the Art

Insulated glass (IG) blinds and shades are well known in the art. IG blinds are enclosed within an IG assembly and include a plurality of slats, cords for raising and lowering the slats, a first operator for moving the cords, and/or a second operator for tilting the slats. Each operator slides on the exterior surface of the glass and is magnetically connected to a follower within the insulated glass. The operators remain in position because of the magnetic force. An example of these magnetic operators may be seen in U.S. Pat. No. 5,699,845 to Jelic It is not uncommon for the operator to break away from the magnetic attraction of the follower. The magnetic retention can be lost if the user jerks the operator or attempts to move the operator beyond its designed travel path. If the operator becomes separated from the follower, then the follower is free to move independently of the operator, for example permitting the blinds to drop quickly to the closed position. When the blinds drop closed, the cords can become tangled making the blinds completely or partially inoperable. Even if the cords do not tangle, the force of the drop may wedge the follower so that the operator is unable to move the follower, preventing the opening or closing of the blinds.

IG blind assemblies contain many pieces, which can make assembly difficult. One such part allows the cords to change from the vertical direction associated with the follower and operator to the horizontal direction in the top rail. Typically, this part is a pulley or a curved piece of plastic with a groove or eyelet. Either type of part is fixed just inside the corner key of the insulated glass spacer. When a curved piece of plastic is used, with time, both the cords and the curved piece of plastic become worn or frayed. Another problem is the frictional resistance between the cord and the plastic, especially after the cord and plastic piece become worn. A pulley overcomes the friction and wear problems, but is more difficult to install or assemble. With either type of part, the assembler must thread the cords through the part during manufacture or assembly of the blind.

SUMMARY OF THE INVENTION

The present invention overcomes the noted problems by providing an IG assembly having (1) an operator trapped between an exterior frame and the exterior glass surface and (2) a pulley integral with an IG spacer corner key.

In a first aspect of the invention, the operator includes a leg trapped between the IG frame and the glass. The operator is slidably operable on the glass assembly even with the leg so trapped. Preferably, the secured leg is L-shaped to prevent inadvertent removal of the operator. The sliding interlock between the operator and the frame assists in continual magnetic cooperation of the operator and the interior follower.

In a second aspect of the invention, one of the insulated glass spacer corner keys includes an integral pulley for the blind cords. Preferably, the pulley is a pin secured to the corner key. As the window is assembled, the cords are placed in position before the pin is inserted into the key. This eliminates the need to thread the cords through the pulleys, thereby reducing installation time. Further preferably, the pulley shaft is smooth and spins freely in the key to reduce wear on the cords.

These and other objects, advantages and features of the invention will become more readily understood and appreciated by reference to the detailed description of the preferred embodiment and the drawings.

DETAILED DESCRIPTION OF THE PREFERRED EMBODIMENT

I. Construction

Figure 1:
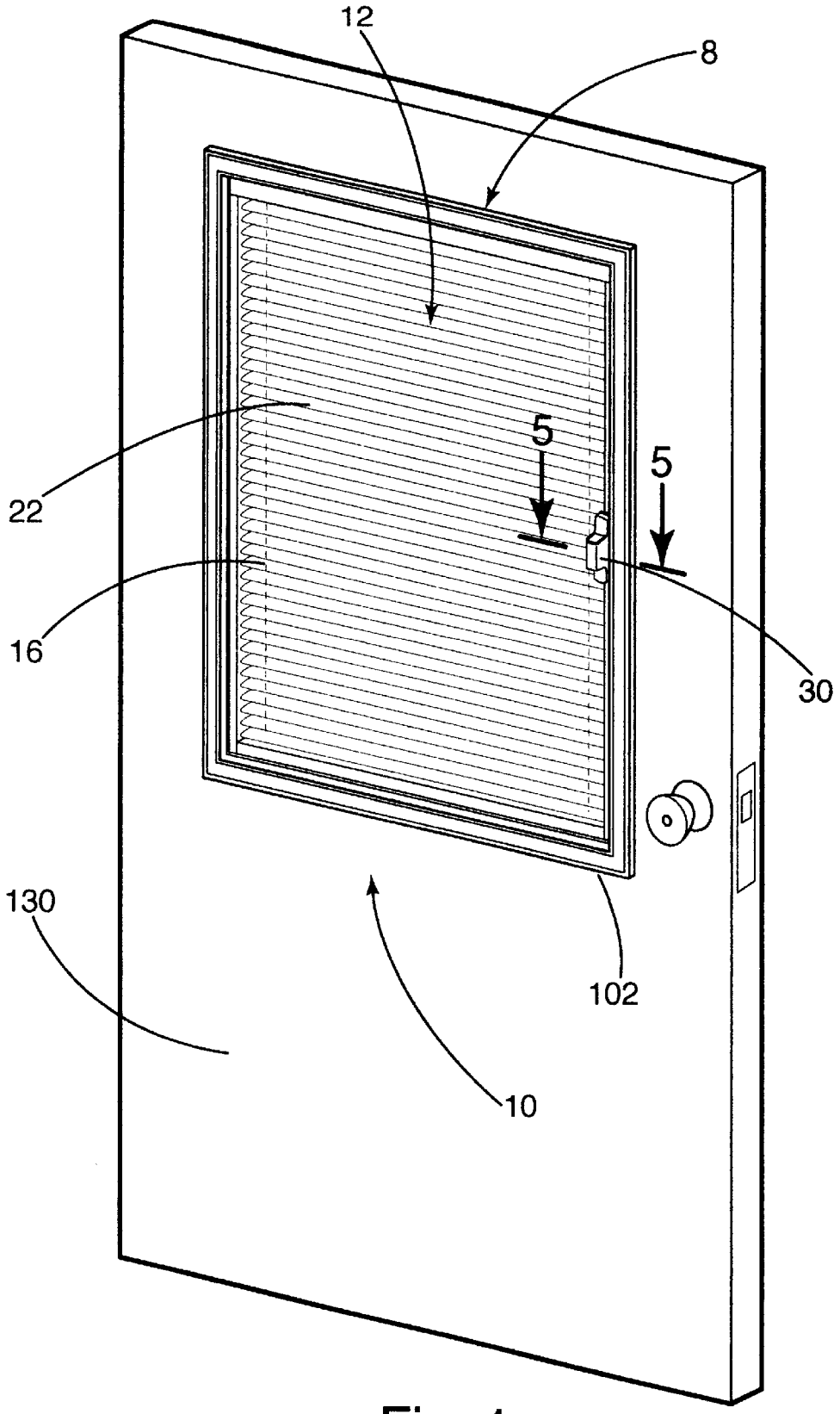
FIG. 1 is a perspective view of the insulated glass blind assembly installed in a door.
Figure 2:
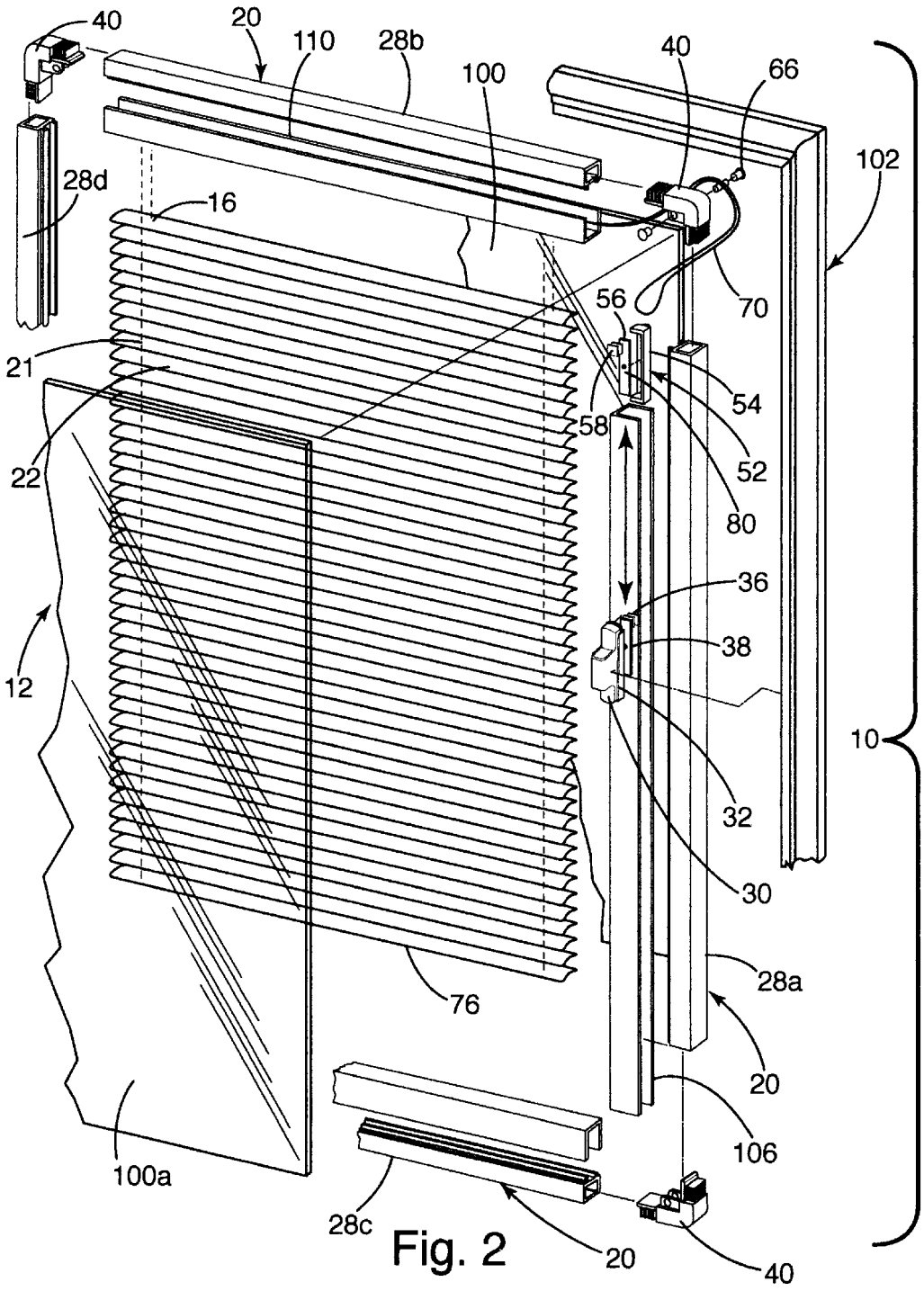
FIG. 2 is an exploded fragmentary perspective view of the glass blind assembly.
Figure 3:
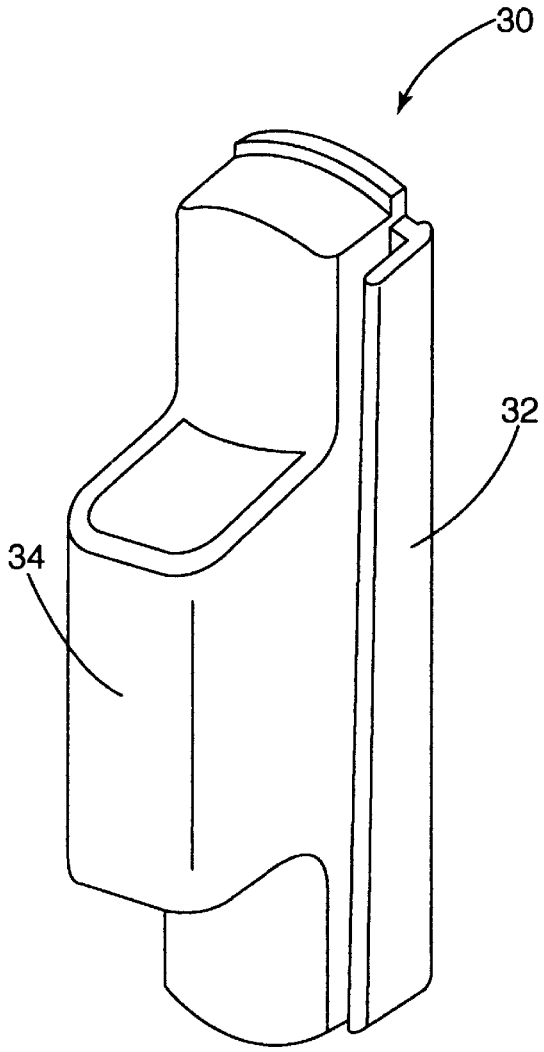
FIG. 3 is a perspective view of the blind operator.
Figure 4:
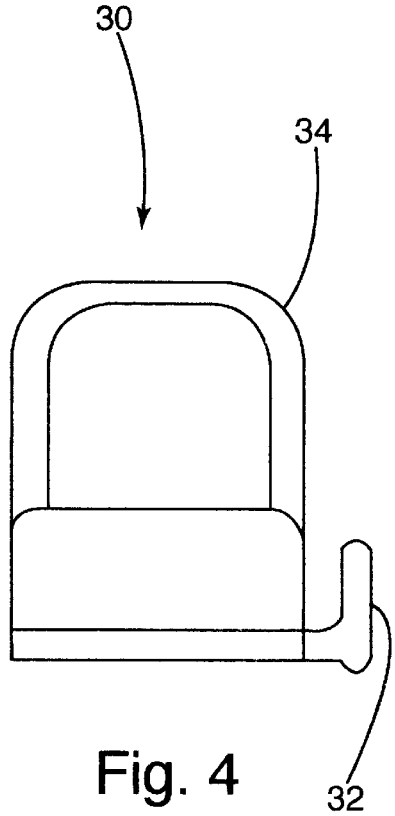
FIG. 4 is a bottom end view of the blind operator.

By way of disclosure and not by way of limitation an insulated glass (IG) blind assembly is illustrated in FIGS. 1–2 and generally designated 10. The insulated glass window/blind assembly 10 generally includes an internal spacer frame 20, a pair of glass panes 100*a–b*, a window covering or a blind assembly 12, a height control operator 30, and a frame 8. The glass panes 100*a–b* are sealed to the internal spacer frame 20. The blind assembly 12 is suspended from the spacer frame 20 and controlled by the height control operator 30. The height control operator 30 is held in place by the frame 8 and slides on one of the glass panes 100.

IG windows are well known and widely used in a variety of applications. IG windows generally include a pair of glass panes or panels 100*a–b* separated by a spacer frame 20. Typically the spacer 20 is aluminum and extends around the perimeter of the assembly, defining a space between the glass panes 100*a–b*. The panes 100*a–b* are adhered and seated to the spacer 20 to secure the assembly together. A desiccant is included within the spacer to absorb moisture within the insulated glass space. The space may be filled with an inert gas to provide an insulation effect.

The spacer frame 20 (FIG. 2) includes a plurality of rails 28*a*, 28*b*, 28*c* and 28*d* interconnected by corner keys 40. The individual rails 28*a–d* all have the same cross section with a length determined by the desired shape. The rails 28*a–d* are well known to those skilled in the art. The spacer frame 20 is generally a rectangular shape with the individual rail members 28*a–d* meeting at right angles although other shapes such as triangles and octagons may be formed. Each rail is formed as an individual piece, and each pair of meeting rails is connected together by the corner key 40.

Figure 6:
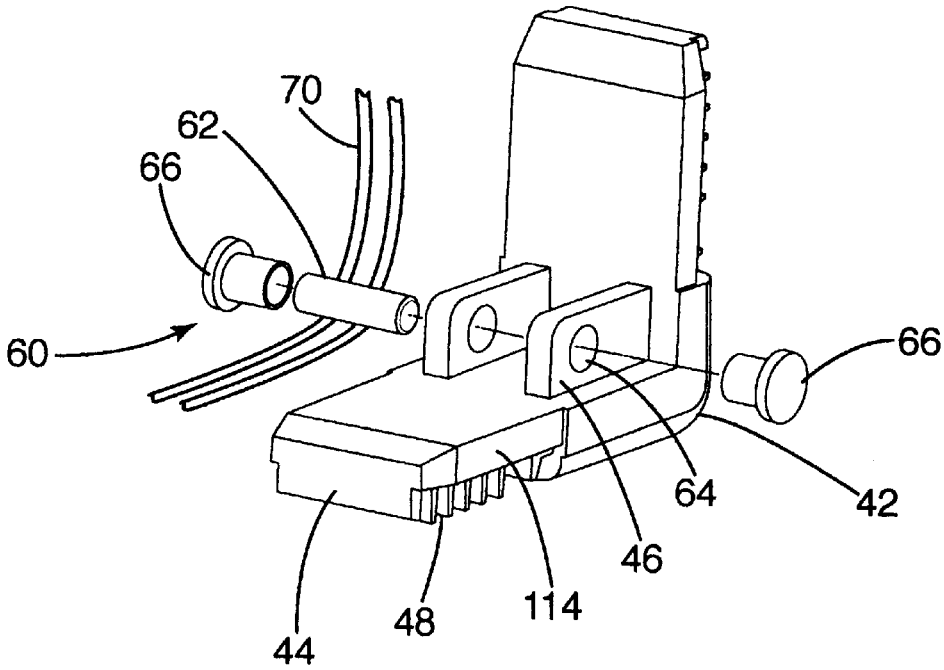
FIG. 6 is an exploded perspective view of the corner key/pulley.
Figure 7:
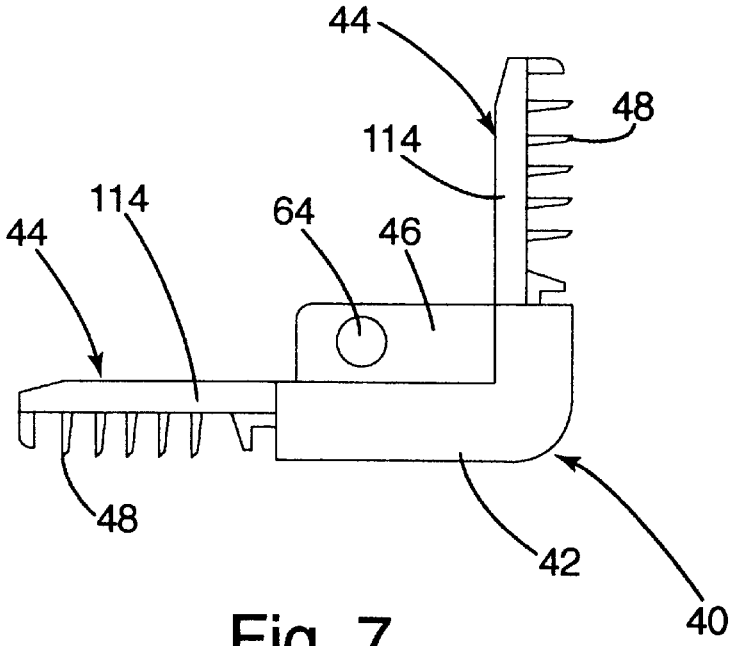
FIG. 7 is a front elevational view of the corner key/pulley.

The corner key 40 (FIGS. 6–7) includes a main body portion 42, legs 44 and pulley mounts 46. Each corner key 40 is preferably injection molded of plastic, although the key may be fabricated of any suitable material. The legs 44 are perpendicularly oriented to each other but may be oriented at other angles to form non-rectangular shapes. The pulley mounts 46 extend between the legs 44.

Each leg 44 includes a base 114, which includes a plurality of ribs 48 along its length. The legs 44 are inserted into the ends of the individual rails of the spacer frame 20. The ribs 48 are thin and slightly flexible. The overall height of the ribs 48 and the base 114 is slightly larger than the opening on the ends of the individual frame members. When the legs 44 are inserted into the rails 28*a–d*, the ribs 48 are bent slightly back. Consequently, the legs 44 are securely retained in the rails. The legs 44 may be made without ribs 48 and may include a fastening means such as a screw, a pin, or adhesive. The fastening means may also be used in combination with the ribs 48.

Each pulley mount 46 defines a circular hole 64, and the two holes 64 on each key are axially aligned. In the preferred embodiment all of the corner keys 40 include the integral pulley mounts 46 for ease in manufacture, inventory and assembly.

The pulley 60 further includes a pin or pulley 62 and a pair of grommets 66. The pin 62 is supported at its opposite ends by grommets 66, which are supported within the holes 64. Each grommet 66 is press fitted into the hole 64. The pin 62 may spin freely like a pulley wheel within the grommet 66. Both the pin 62 and the grommet 66 are preferably made of a metallic material such as steel or brass, but plastic or other suitable materials may be used.

The blind assembly 12 includes a plurality of individual slats 22, a head rail 110, a string ladder 16, a cord 70, a follower 52, and a cover 106. The individual slats 22 are suspended from the head rail 110 on the string ladder 16. The individual slats 22 are adjusted by changing the position of the weighted bottom rail 76.

The cord 70 is secured to each side of the weighted bottom rail 76 and passes upward through the apertures 21 on the individual slats 22 and into the head rail 110. In the head rail 110 the cord 70 is directed along its length to the pulley 60 on the corner key 40. The cord passes over the pin 62 and down to the follower 52 within the cover 106.

Figure 5:
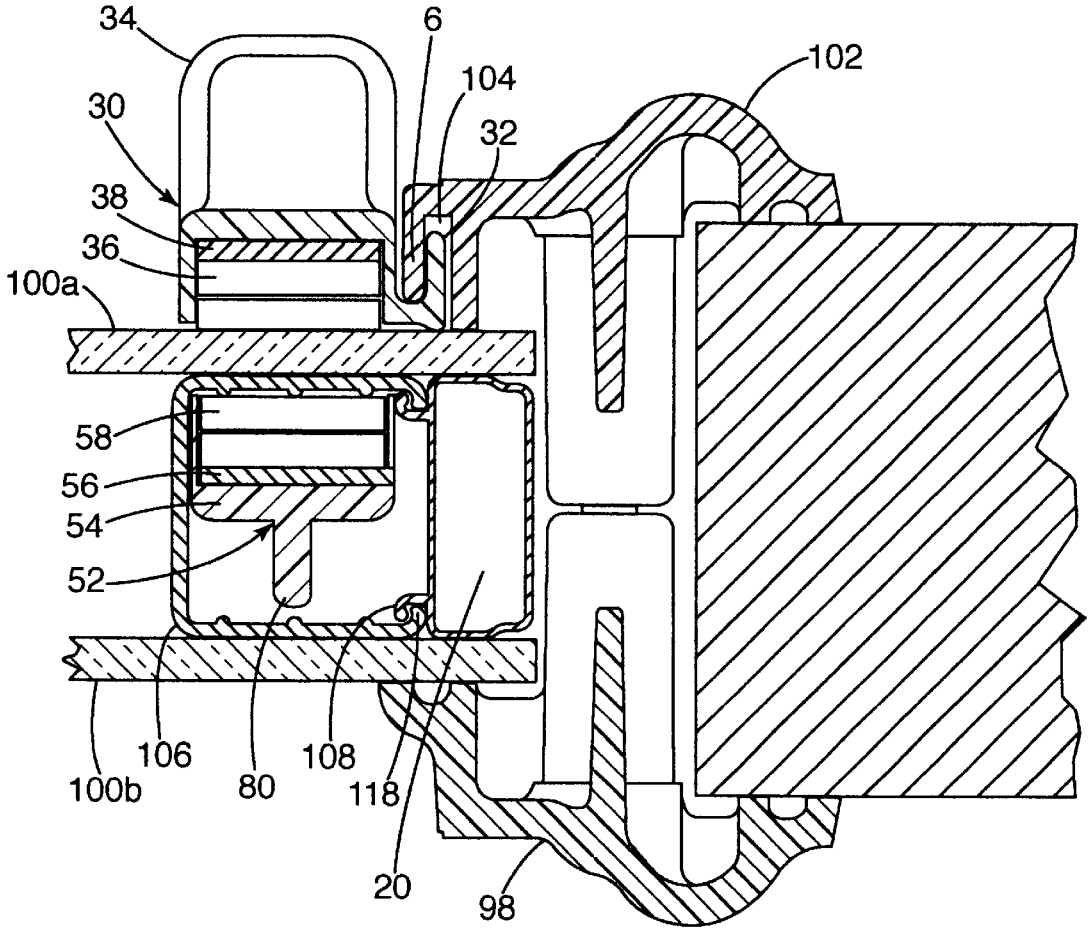
FIG. 5 is a fragmentary cross sectional view taken along lines V—V in FIG. 1.

The follower 52 (FIGS. 2 and 5) includes a magnet holder 54, at least one magnet 58, and a magnet back plate 56. The holder 54 is made of injection molded plastic and includes an attachment point 80 to secure the cord 70 to the follower 52. The magnetic back plate 56 is secured within the holder 54 by an adhesive or a fastening means. Magnets 58 are secured through magnetic force to the magnetic back plate 56. Preferably 10 smaller magnets 58 are stacked within the holder 54. The type, shape, number, and location of the magnets will vary from application to application.

The cover 106 is a rectangular c-shape and is attached to small j hooks 108 on at least one of the side individual rails of the spacer frame 20. The ends 118 snap over the j hooks 108 providing an enclosure for the follower 52. The cover 106 may be attached to one side, both sides, and/or the bottom of the spacer frame 20.

The frame 8 includes frame halves 98 and 102. The insulated window/blind assembly 10 is held within a supporting structure 130 by the frame halves 98 and 102. The exterior frame half 98 is well known in the art. The interior frame half 102 is similar to the exterior frame half 98 but includes a leg 6 that defines an interior groove or channel 104. The interior frame half 102 is also well known in the art, except for channel 104. The channel 104 may preferably run along only one side of the interior frame 102 or around its entire circumference. The leg 6 is paced from the glass pane 100*a*. The height control operator 30 is attached to the blind assembly by this channel 104.

The height control operator 30 (FIGS. 2–5) includes a secured leg 32, a handle 34, at least one magnet 36 and a magnetic plate 38. The magnetic plate is secured to the operator 30 by an adhesive, screw, or other securing means. The magnets 44 are held to the magnetic plate 38 by a magnetic force. Preferably, 10 small magnets 36 are stacked within the operator 30. The type, shape, number, and location of the magnets will vary from application to application. Further, the follower magnets 58 and the operator magnets 36 as well as the operator magnetic back plate of the operator 38 and follower magnetic back plate 56 preferably are identical for ease of manufacture, installation and inventory. The secured leg 32 is held within the channel 104 on the interior decorative frame 98. Accordingly, the operator 30 is restricted to sliding linear movement along a linear path.

II. Assembly

The spacer frame 20 is assembled out of individual rail members and corner keys 40. The corner keys 40 are inserted into the ends of the individual rail members forming the spacer frame 20. The blind assembly 12 is then installed on the spacer frame 20. More specifically, the individual blind slats 22 are supported on a string ladder 16 and attached to the head rail 110. The head rail 110 is a rectangular c-shape and preferably attached by j hooks 108 as the cover 106 is attached to the individual side rails. A second operator (not shown) may actuate a tilt mechanism to tilt the string ladder 16 thereby tilting the slats 22 open and closed. The second operator may be attached to the inner frame half 102 by a channel similar to the channel 104 for the height control operator 30. The cord 70 is attached to the weighted bottom rail 76, threaded through the apertures 21 on the individual slats 22 and into the head rail 110. The cord 70 then runs lengthwise along the head rail 110 to where the pulley 60 will be installed and down to the follower 52 where it is attached by the attachment point 80.

After the frame 8 has been assembled and the cord 70 run, the pulley 60 is installed on at least one of the corner keys 40. The pin 62 is inserted into the pulley mounts 46 and the grommets 66 are press fitted into the pulley mounts 46 surrounding the pin 62. The cover 106 is then snap fitted onto one of the side rails of the spacer frame 20 enclosing the follower 52 and the cord 70.

The glass panes 100*a–b* are sealed to the spacer frame 20 and thereby enclose the blind assembly 12. The height control operator 30 is attached to the interior frame half 102 by the secured leg 32 fitting within the channel 104. The interior and exterior frame halves 102 and 98 are placed on each side of the sealed unit and secured together by a fastening means. The completed insulated glass window/blind assembly 10 may then be shipped to a destination point for possible storage and subsequent installation.

III. Operation

In operation the height control operator 30 is moved to raise or lower the individual blind slats 22. The operator 30 slides within a channel 104 on the interior decorative frame 102. The channel 104 may be limited to a portion of the interior frame 102 to ensure that the operator 30 does not slide past the range of the follower 52, thereby losing magnetic contact with the follower 52. The magnetic force between the operator magnets 36 and the follower magnets 58 causes the follower 52 to follow the operator 30. As the individual slats 22 are being raised the cord 70 travels across the pulley 60 spinning the pin 62, while the operator 30 is pulled downward. The magnetic force between the operator 30 and the follower 52 sandwiches the glass pane 100 and cover 106 between them causing the friction to maintain the slats 22 in an open or partially open position.

The above description is that of the preferred embodiment of the invention. Various alterations and changes can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. A window blind assembly comprising:

an insulated glass including a spacer and a pair of glass panels connected to said spacer;

frame means for supporting said insulated glass within an opening, said frame means defining a liner recess adjacent said insulated glass;

a blind within said insulated glass between said glass panels; and a mechanism for raising and lowering said blind, said mechanism including a magnetic operator outside of said insulated glass, said operator including a portion extending into and riding within said recess between said interior frame and said insulated glass to restrict movement of said operator to a linear direction along said insulated glass.

2. The window blind assembly of claim 1 wherein said spacer further comprises:

a plurality of individual rail members interconnected by a plurality of corner keys; and a rotatable pulley directly supported by one of said corner keys.

3. The window blind assembly of claim 2 further comprising a pair of bushings supporting said rotatable pulley within said one corner key.

4. The window blind assembly of claim 1 wherein said mechanism for raising and lowering said blind further comprises a follower inside said insulated glass, said follower and said operator being magnetically coupled.

5. A window comprising:

a window assembly including a pair of spaced panels defining an interior space therebetween a frame assembly surrounding said window assembly, said frame assembly defining a linear internal groove facing said window assembly;

a window covering within said interior space of said window assembly;

an operator slidably engaging one of said panels opposite said interior of said window assembly, said operator including a portion extending into said internal groove, whereby the movement of said operator is confined to a linear path adjacent said one panel; and means for moving said window covering in response to movement of said operator.

6. The window of claim 5 wherein said means for moving said window covering comprises:

a follower within said interior space of said window assembly;

first and second magnets carried by said operator and said follower respectively; and a cord attached to said follower and said window covering.

7. The window of claim 5 wherein said window assembly includes a spacer frame including a plurality of individual rails and a plurality of corner keys connecting said rails, one of said corner keys including an integral pulley support.

8. The window of claim 7 further comprising a pulley supported by said integral pulley support.

9. The window of claim 8 wherein said pulley comprises a pin supported by a pair of grommets.

10. The window of claim 5 wherein said window assembly is sealed in an insulated construction.

11. A window comprising:

a spacer frame including a plurality of frame members and a plurality of corner keys, said corner keys interconnecting said frame members;

a pulley directly supported by one of said corner keys;

a pair of glazing panels connected to said spacer frame;

a window covering between said panels, said window covering including a cord extending over said pulley;

a frame surrounding said glazing panels and defining a linear channel adjacent to one of said glazing panels; and a window covering operator slidably engaging said one glazing panel, said operator including a portion between said one glazing panel and said frame, said portion extending into said linear channel, whereby the motion of the operator is restricted to a linear path against said one glazing panel.

12. The window of claim 11 wherein said pulley comprises a pin and a bushing rotatably supporting said pin within said one corner key.

13. The window of claim 11 further comprising:

a cover attached to said spacer frame;

a magnetic follower within said cover in slidable communication with said operator;

a plurality of magnets being disposed in said operator and said follower;

an attachment point on said follower; and a cord attached to said attachment point.

14. A window unit comprising:

an insulated glass spacer flame including a plurality of rail members and a plurality of corner keys interconnecting said rail members, at least one of said corner keys being a single unitary piece including an integral pulley support;

a pulley directly supported by the pulley support of said at least one corner key;

a pair of glass panes connected to said rail members forming an insulted glass assembly; and a window covering sealed within said glass assembly and including an operator cord extending about said pulley.

15. The window unit of claim 14 wherein said pulley comprises a pin supported by a pair of grommets.

16. The window unit of claim 14 wherein said corner key includes an integrally molded pulley mount said pulley being mounted thereon.

* * * * *

UNITED STATES PATENT AND TRADEMARK OFFICE

CERTIFICATE OF CORRECTION

PATENT NO. : 6,601,633 B2
DATED : August 5, 2003
INVENTOR(S) : Luann Y. Sun et al.

It is certified that error appears in the above-identified patent and that said Letters Patent is hereby corrected as shown below:

Column 5,
Line 10, "liner" should be -- linear --
Line 37, after "therebetween" insert -- ; --

Column 6,
Line 41, "flame" should be -- frame --

Signed and Sealed this

Twenty-eighth Day of October, 2003

JAMES E. ROGAN
*Director of the United States Patent and Trademark Office*